US011183779B2

(12) United States Patent
Eicher

(10) Patent No.: US 11,183,779 B2
(45) Date of Patent: Nov. 23, 2021

(54) PRESS-IN PIN AND METHOD FOR PRODUCING SAME

(71) Applicant: EPT Holding GmbH & Co. KG, Peiting (DE)

(72) Inventor: Hermann Eicher, Steingaden (DE)

(73) Assignee: EPT Holding GmbH & Co. KG, Peiting (DE)

( * ) Notice: Subject to any disclaimer, the term of this patent is extended or adjusted under 35 U.S.C. 154(b) by 60 days.

(21) Appl. No.: 16/629,323

(22) PCT Filed: Jul. 12, 2018

(86) PCT No.: PCT/EP2018/068966
§ 371 (c)(1),
(2) Date: Jan. 8, 2020

(87) PCT Pub. No.: WO2019/012050
PCT Pub. Date: Jan. 17, 2019

(65) Prior Publication Data

US 2021/0036442 A1 Feb. 4, 2021

(30) Foreign Application Priority Data

Jul. 12, 2017 (DE) ..... 10 2017 115 697.6

(51) Int. Cl.
*H01R 4/58* (2006.01)
*H01R 12/58* (2011.01)
*H01R 43/00* (2006.01)

(52) U.S. Cl.
CPC ..... *H01R 4/58* (2013.01); *H01R 12/585* (2013.01); *H01R 43/00* (2013.01)

(58) Field of Classification Search
CPC ..... H01R 4/58; H01R 12/585; H01R 43/00; H01R 13/03; Y10S 439/931
See application file for complete search history.

(56) References Cited

U.S. PATENT DOCUMENTS 9,728,878 B2 * 8/2017 Shibuya ..... C25D 5/12
2005/0176267 A1 * 8/2005 Saitoh ..... H01R 12/585 439/49
2008/0188100 A1 8/2008 Saitoh
(Continued)

FOREIGN PATENT DOCUMENTS

CN 1674359 A 9/2005
DE 10 2009 008 118 A1 8/2009
(Continued)

OTHER PUBLICATIONS

International Search Report and Written Opinion for PCT/EP2018/068966 dated Aug. 29, 2018 (12 pages; with English translation).
(Continued)

*Primary Examiner* — Tho D Ta
(74) *Attorney, Agent, or Firm* — Mindful IP PLLC

(57) ABSTRACT

The disclosure relates to a press-in pin having a tin-free and lead-free surface coating. The press-in pin also has an outer second coating. By suitable treatment after the outer second coating has been applied to the first coating, a transition layer is formed between the first coating and the outer second coating.

9 Claims, 2 Drawing Sheets

(56) References Cited

U.S. PATENT DOCUMENTS

| | | | | |
|---|---|---|---|---|
| 2014/0113504 | A1* | 4/2014 | Moser | H01R 13/03<br>439/751 |
| 2016/0276769 | A1* | 9/2016 | Pscherer | H01R 13/03 |

FOREIGN PATENT DOCUMENTS

| | | | |
|---|---|---|---|
| DE | 10 2009 047 043 | A1 | 4/2011 |
| EP | 2811051 | A1 | 12/2014 |

OTHER PUBLICATIONS

Office Action for CN 201880045369.0 dated Mar. 25, 2021 from China National Intellectual Property Administration with English Translation.

Chinese National Intellectual Property Adminislalion Search Report for Chinese patent application 201880045369.0 dated Oct. 12, 2020 (English translation only).

* cited by examiner

PRESS-IN PIN AND METHOD FOR PRODUCING SAME

CROSS-REFERENCE TO RELATED APPLICATIONS

This application is a national stage of, and claims priority to, Patent Cooperation Treaty Application No. PCT/EP2018/068966, filed on Jul. 12, 2018, which application claims priority to German Application No. DE 10 2017 115 697.6, filed on Jul. 12, 2017, which applications are hereby incorporated herein by reference in their entireties.

DESCRIPTION

The disclosure relates to a press-in pin for a printed circuit board or for a lead frame, a contacting with such a press-in pin, a printed circuit board or the like realized with such a contacting, and a method for producing such a press-in pin.

The press-in technology produces solder-free electrical and mechanical connections by pressing a press-in pin into a contact hole of a printed circuit board or of a lead frame. The quality of a press-in connection depends apart from the contact partners, press-in pin, and printed circuit board or lead frame, also on the surface used in the contact area. The surfaces tin or tin-lead are mainly used on the press-in pins.

A disadvantage of such press-in pins with tin surface is the danger of whisker formation, which is reduced by the addition of lead. However, the use of lead in electrical and electronic equipment is prohibited by the RoHS Directive. Due to a lack of alternatives, however, there is an exceptional provision for the use in press-in technology.

DE 10 2009 008 118 A1 discloses a press-in pin with a coating made of gold or of a gold alloy or of silver or of a silver alloy or of aluminum or of copper. The coating serves to reduce whisker formation. An additional antioxidant layer is applied to this coating.

A similar press-in connection is disclosed in DE 10 2009 047 043 A1. In this connection, one of the joining partners, for example the press-in pin, is provided with a copper-containing coating on which an organic solderability preservative (OSP) is applied.

In view of this, the disclosure is based on the object of creating an improved press-in pin and a method for its production, wherein an electrical and/or mechanical connection with a contact hole (in particular a printed circuit board or a lead frame) can be established with the press-in pin, wherein the press-in pin has a surface coating which reduces whisker formation. The disclosure is furthermore based on the object to create an improved contacting applicable to a printed circuit board, a lead frame or the like.

This object is solved with regard to the press-in pin, the contacting, the printed circuit board, the lead frame, and the method by features as disclosed herein.

The claimed press-in pin serves to establish an electrical and/or mechanical contact by means of press-in technology, whereby it is pressed into a contact hole, in particular into a printed circuit board or lead frame or into another substrate. The claimed press-in pin has a coating made of gold or of a gold alloy or of silver or of a silver alloy or of aluminum or of copper. Thus, the press-in pin has a tin-free and lead-free surface coating. The advantage of this surface coating is that on the one hand, no prohibited or dangerous substances such as lead are used, and on the other hand, whisker formation is reduced due to the absence of tin. The press-in pin also has an external second coating, whereby after applying the second coating to the first coating, a transition layer is formed between the first and the second coating by suitable treatment.

It turned out that this layer structure, in which an intermediate third layer is formed from an initially two-layer coating by suitable treatment, the surface quality is further improved.

In a preferred development, the second coating is an organic layer, preferably an organic surface protection.

Preferably, the second coating is mechanically, thermally or chemically bonded to the first coating, wherein after the second coating has been applied to the first coating, the transition/interface layer is formed.

This transition layer may be an oxidation layer or a diffusion layer or an interface layer formed by other ways.

The electrical contacting is formed with such a press-in pin which is pressed into a suitable contact hole, e.g. a printed circuit board.

Preferably, the electrical contacting or connection is gas-tight.

The electrical contacting is preferably provided on or in an electrical printed circuit board or an electrical lead frame.

In the method according to the disclosure for producing a press-in pin for subsequent pressing-in into a contact hole—in particular a printed circuit board, a lead frame or another substrate—first of all a first coating made of gold or of a gold alloy or of silver or of a silver alloy or of copper or of aluminum is applied. According to the disclosure, this is followed by applying a second coating and forming a transition layer.

In a particularly preferred further development of the method, the transition layer is formed thermally, chemically and/or mechanically.

The transition layer can be formed, for example, by diffusion processes or oxidation processes.

Preferred examples of the disclosure are explained in more detail in the following using schematic drawings. They show:

Figure 1:
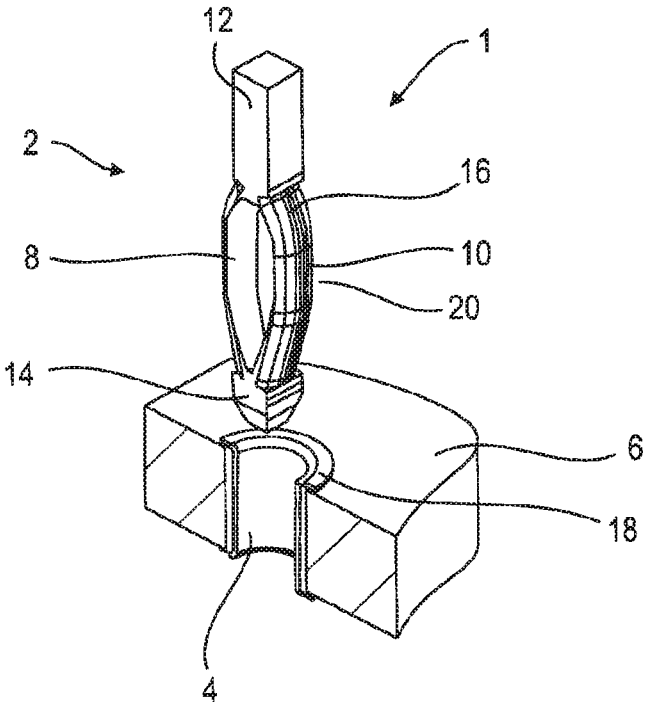
FIG. 1 shows a schematic diagram of a contacting according to the disclosure.

FIG. 1 shows a schematic diagram of a contacting 1 according to the disclosure, which is executed in press-in technology. A press-in pin 2 is pressed into a contact hole 4 of a printed circuit board 6. In the example shown in FIG. 1, the press-in pin 2 is realized with two legs 8, 10, which are arched in shape and which extend away from a pin body 12 towards a pin head 14. Of course, the press-in pin 2 can also be realized in other ways.

The contact hole 4 is provided with a suitable coating consisting of gold or a gold alloy, silver or a silver alloy, copper or a copper alloy or tin, for example. A multi-layer structure is also possible.

Figure 3:
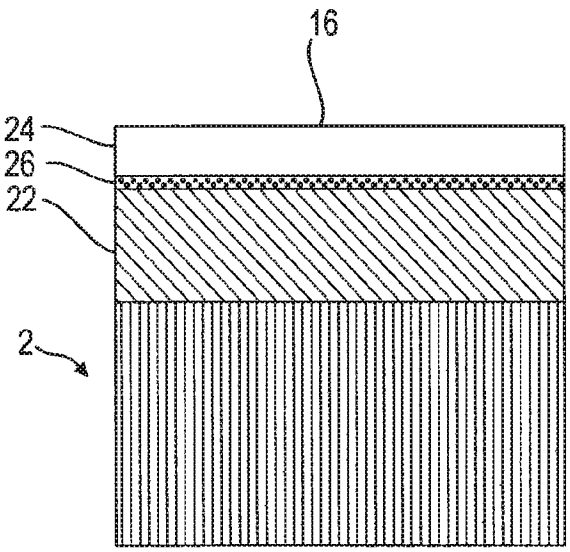
FIG. 3 shows a schematic cross-section of a press-in pin according to the disclosure.
Figure 2:
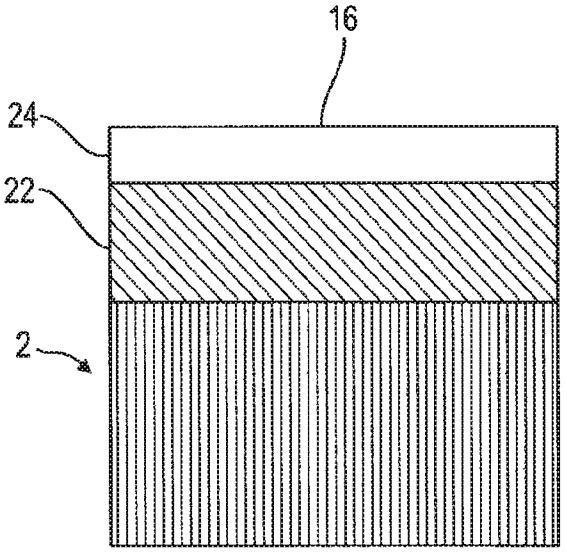
FIG. 2 shows a schematic sectional view of the layer structure of a press-in pin according to the disclosure before the formation of a transition layer.

The basic material of the press-in pin 2 consists, for example, of an aluminum-based or copper-based alloy. This base material is then coated in the manner described below. FIGS. 2 and 3 show the layer structure of a press-in zone 16 of the press-in pin 2.

A contact area 20 provides the electrical contact between press-in pin 2 and contact hole 4 (e.g. printed circuit board hole). The press-in zone 16 formed by the two legs 8, 10, on which the contact area 20 is also formed, provides a force-locking connection between the press-in pin 2 and the contact hole 4. The connection between press-in pin 2 and contact hole 4 is gas-tight.

The press-in zone 16 of the press-in pin 2 has a first coating 22 made of gold or a gold alloy, of silver or a silver alloy, of copper or of aluminum as shown in FIG. 2, on which an additional second coating 24 is applied. This additional coating can, for example, be applied mechanically or chemically (by deposition) to the first coating 22. This second coating 24 is preferably an organic layer which forms an organic surface protection. Such organic solderability preservatives are known in printed circuit board technology under the abbreviation OSP, so that further explanations are unnecessary.

This intermediate product of a press-in-pin 4 provided with a first coating 22 and a second coating 24, preferably with an organic coating, is shown in FIG. 2. This intermediate product corresponds more or less to the prior art described above.

According to the disclosure, a transition layer 26 shown in FIG. 3 is then formed on the intermediate product by suitable mechanical, thermal and/or chemical treatment. This transition layer 26 is formed in the interface layer region between the first coating 22 and the second coating 24 and can be formed by diffusion or oxidation processes, by chemical reactions or in any other way, depending on process control and choice of material.

This layer/layer structure formed in this way serves on the one hand as protection against oxidation and on the other hand to reduce the press-in forces when pressing the press-in pin into the contact hole so that damage to the printed circuit board 6 or the lead frame is avoided.

A sufficiently high holding force is guaranteed by the clamping force of the press-in zone 16 of the press-in pin 2 and by frictional locking between the contact area 20 and the contact hole 4.

The contact hole 4 has, as explained, a coating made of gold or a gold alloy, or of silver or a silver alloy, or of copper, preferably with an additional coating against oxidation, thereby reducing whiskers. Optionally, the contact hole can also be coated with tin.

Al-based or Cu-based alloys can be used as materials for the press-in pin 2.

A press-in pin is disclosed, wherein the pin material has two surface coatings between which a transition layer is formed.

LIST OF REFERENCE SIGNS

1 contacting
2 press-in pin
4 contact hole
6 printed circuit board/lead frame
8 leg
10 leg
12 pin body
14 pin head
16 press-in zone
18 coating contact hole
20 contact area
22 first coating
24 second coating
26 transition layer

The invention claimed is:

1. A press-in pin for being pressed into a contact hole, the press-in pin comprising a press-in zone, the press in zone including a first coating made of gold or of a gold alloy or of silver or of a silver alloy or of copper, or of aluminum, on which an outer second coating is applied, wherein a transition layer is formed between the first coating and the outer second coating, and further wherein the outer second coating is an organic layer, and the transition layer is formed after applying the organic layer to the first coating, and wherein the organic layer is an organic surface protection, and wherein the transition layer is an oxidation or diffusion layer.

2. The press-in-pin according to claim 1, wherein the outer second coating is mechanically and/or chemically bonded to the first coating and the transition layer is formed subsequently.

3. The press-in-pin according to claim 1, wherein the transition layer is formed by a chemical, a mechanical and/or a thermal treatment.

4. An electrical contacting with the contact hole into which the press-in pin is pressed according to claim 1.

5. The electrical contacting according to claim 4, wherein the contact hole comprises a coating made of gold or a gold alloy, of silver or a silver alloy or of copper or tin, preferably with an additional coating against oxidation.

6. The electrical contacting according to claim 4, wherein the electrical contacting is gas-tight.

7. An electric conductor plate or electric lead frame with the electrical contacting according to claim 4.

8. A method of producing a press-in pin having a press-in zone for being pressed into a contact hole, comprising:

applying a first coating made of gold or gold alloy or of silver or a silver alloy or of copper or of aluminum to the press-in zone;

applying a second coating on the first coating, wherein the second coating is an organic layer which forms an organic surface protection; and subsequently forming a transition layer between the first coating and the second coating, wherein the transition layer is an oxidation or diffusion layer.

9. The method according to claim 8, wherein the transition layer is formed chemically, mechanically and/or thermally.

* * * * *